US010829711B2

(12) United States Patent
Nakanishi et al.

(10) Patent No.: US 10,829,711 B2
(45) Date of Patent: Nov. 10, 2020

(54) GREASE, MECHANICAL COMPONENT, AND METHOD FOR PRODUCING GREASE

(71) Applicant: IDEMITSU KOSAN CO., LTD., Chiyoda-ku (JP)

(72) Inventors: Yusuke Nakanishi, Ichihara (JP); Hiromu Kumagai, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 15/569,429

(22) PCT Filed: Apr. 27, 2016

(86) PCT No.: PCT/JP2016/063271
§ 371 (c)(1),
(2) Date: Oct. 26, 2017

(87) PCT Pub. No.: WO2016/175258
PCT Pub. Date: Nov. 3, 2016

(65) Prior Publication Data

US 2018/0079983 A1 Mar. 22, 2018

(30) Foreign Application Priority Data

Apr. 30, 2015 (JP) ..... 2015-093187

(51) Int. Cl.

| | |
|---|---|
| ***C10M 119/20*** | (2006.01) |
| ***C10M 169/06*** | (2006.01) |
| ***C10M 175/00*** | (2006.01) |
| ***C10M 177/00*** | (2006.01) |
| *C10N 20/06* | (2006.01) |
| *C10N 20/00* | (2006.01) |
| *C10N 30/08* | (2006.01) |
| *C10N 30/00* | (2006.01) |
| *C10N 50/10* | (2006.01) |
| *C10N 50/00* | (2006.01) |

(52) U.S. Cl.
CPC ..... *C10M 119/20* (2013.01); *C10M 169/06* (2013.01); *C10M 175/0083* (2013.01); *C10M 177/00* (2013.01); *C10M 2201/02* (2013.01); *C10M 2203/1025* (2013.01); *C10M 2205/0285* (2013.01); *C10M 2207/022* (2013.01); *C10M 2207/288* (2013.01); *C10M 2207/289* (2013.01); *C10M 2207/2845* (2013.01); *C10M 2207/401* (2013.01); *C10M 2209/084* (2013.01); *C10M 2209/12* (2013.01); *C10M 2215/102* (2013.01); *C10M 2290/02* (2013.01); *C10M 2290/10* (2013.01); *C10N 2020/06* (2013.01); *C10N 2020/063* (2020.05); *C10N 2030/08* (2013.01); *C10N 2030/26* (2020.05); *C10N 2030/62* (2020.05); *C10N 2050/015* (2020.05); *C10N 2050/10* (2013.01)

(58) Field of Classification Search
CPC ..... C10M 2209/12; C10M 2201/02
USPC ..... 508/219
See application file for complete search history.

(56) References Cited

U.S. PATENT DOCUMENTS

| | | | | |
|---|---|---|---|---|
| 2005/0197260 | A1* | 9/2005 | Johnson | C10M 169/02 508/216 |
| 2011/0084421 | A1* | 4/2011 | Soane | C09D 7/65 264/219 |
| 2013/0200299 | A1* | 8/2013 | Mazyar | E21B 43/128 252/75 |
| 2013/0256064 | A1* | 10/2013 | Bongaerts | B01J 20/24 184/102 |
| 2014/0011722 | A1* | 1/2014 | Garner | C10M 145/40 508/307 |
| 2016/0145480 | A1* | 5/2016 | Krigstin | D21H 19/12 427/389.7 |

FOREIGN PATENT DOCUMENTS

| | | | |
|---|---|---|---|
| CN | 103189485 | A | 7/2013 |
| CN | 103087811 | A | 8/2013 |
| CN | 104024515 | A | 9/2014 |
| CN | 104073323 | A | 10/2014 |
| DE | 31 26 593 | A1 | 1/1983 |
| JP | 64-85295 | A | 3/1989 |
| JP | 2005-272502 | A | 10/2005 |
| JP | 2006-501349 | A | 1/2006 |
| JP | 2008-274091 | A | 11/2008 |
| JP | 2010-100702 | A | 5/2010 |
| JP | 4986341 | B2 | 7/2012 |
| JP | 2013-116991 | A | 6/2013 |
| JP | 2013-216810 | A | 10/2013 |
| JP | 2013-249449 | A | 12/2013 |
| JP | 2014-91762 | A | 5/2014 |
| JP | 2014-214264 | A | 11/2014 |
| KR | 20100044720 | A | 4/2010 |
| WO | 2010/073758 | A1 | 7/2010 |
| WO | WO 2012/055821 | A1 | 5/2012 |
| WO | 2016/021690 | A | 2/2016 |

OTHER PUBLICATIONS htemational Search Report dated Jul. 26, 2016, in PCT/JP2016/063271, filed Apr. 27, 2016.

(Continued)

*Primary Examiner* — Vishal V Vasisth
(74) *Attorney, Agent, or Firm* — Oblon, McClelland, Maier & Neustadt, L.L.P.

(57) ABSTRACT

Provided is a grease containing a base oil and a hydrophilic nanofiber, the hydrophilic nanofiber having a thickness (d) of 0.01 to 500 nm being dispersed therein. The grease is low in an environmental load and excellent in safety on the human body and also has an appropriate worked penetration and has a high dropping point, and therefore, it is also excellent in heat resistance.

11 Claims, No Drawings

(56) References Cited

OTHER PUBLICATIONS

Extended European Search Report dated Aug. 7, 2018 in Patent Application No. 16786534.4, 7 pages.
Huang, Y. et al. "Hydrophobic Modification of Chitin Whisker and Its Potential Application in Structuring Oil", Langmuir, vol. 31, XP055496019, 2015, pp. 1641-1648.
Office Action dated Jul. 9, 2019 in European Patent Application No. 16 786 534.4.
Office Action dated Jun. 4, 2019 in Japanese Patent Application No. 2017-515590, 13 pages (with unedited computer generated English translation).
Reference No. Dispatch No. 008839; Dispatch Date: Jan. 29, 2019; Notification , Jan. 22, 2019 Commissioner of JPO; Attorney for Patent Submitter; Mr. Tamotsu Ohtani (and other one person); Patent Application No. 2017-515590.
Shinsuke Ifuku, Keisuke Tani, Hiroyuki Saimoto, Minoru Morimoto, Saburo Minami, Electronic, Technical Information 1, [Patent] 2017-515590; [Date of Acceptance] Dec. 28, 2018, "Search of effects and use of chitin nanofibers to be isolated from crab shells on living bodies". Graduate School of Engineering. Tottori University Department of Veterinary Medicine, Faculty of Agriculture, Tottori University, Research Center for Bioscience and technology, Tottori University.
Tajima Kenji, Oze Ryota, Hiroaki Sakurai; "Mass production of cellulose with acetic acid bacteria and fermentation nanocellulose (NFBC)", Copyright 2016 Agriculture & Livestock Industries Corporation.
Uni Mitsubishi pencil co., Ltd., "Next-generation material 'nanofiber' commercialization of world's first! But write speed kasure delivers not SKIP FREE lines Development of gelinkballpen uni ball signo UMN-307", Sep. 8, 2015.
Office Action dated Jun. 19, 2020, in Chinese Patent Application No. 201680024421, filed Apr. 27, 2016 w/English translation.
R. Sanchez et al., "Development of new green lubricating grease formulations based on cellulosic derivatives and castor oil", Green Chemistry, Feb. 25, 2009, pp. 686-693.
R. Sanchez et al., "Rheological and mechanical properties of oleogels based on castor oil and cellulosic derivatives potentially applicable as bio-lubricating greases: Influence of cellulosic derivatives concentration ratio", Journal of Industrial and Engineering Chemistry, 2011. pp. 705-711.

* cited by examiner

GREASE, MECHANICAL COMPONENT, AND METHOD FOR PRODUCING GREASE

CROSS-REFERENCE TO RELATED APPLICATIONS

This application is a National Stage of PCT/JP2016/063271, which was filed on Apr. 27, 2016. This application is based upon and claims the benefit of priority to Japanese Application No. 2015-093187, which was filed on Apr. 30, 2015.

TECHNICAL FIELD

The present invention relates to a grease, a mechanical component using the grease, and a method for producing a grease.

BACKGROUND ART

A grease is widely used for lubrication of various sliding portions of automobiles and various industrial machines from reasons that it is easy for achieving sealing as compared with a lubricating oil; that it is possible to achieve miniaturization or weight reduction of a machine to be applied; and the like.

The grease is chiefly constituted of a base oil and a thickener. Solid-like properties of the grease are given by the thickener, and performances of the grease largely vary with the thickener to be used.

As the thickener that is in general widely used, there are exemplified a fatty acid metal salt, such as lithium soap, etc., and a diurea compound (see, for example, PTL 1).

However, the diurea compound involves a problem in an environmental aspect or a safety aspect on the human body. In particular, an isocyanate-based compound that is a raw material of the diurea compound has mutagenicity and is detrimental to the human body. In addition, as for greases using lithium soap that is the fatty acid metal salt, there are a lot of materials having a low dropping point, and there are a lot of materials that are not suitable for use in a site where the temperature becomes high.

Recently, greases using a thickener that is low in an environmental load, is excellent in safety on the human body, and has biodegradability are developed.

For example, as a biodegradable grease composition having biodegradability and also having excellent lubricity, heat resistance, and durability, PTL 2 discloses a grease composition that is characterized by containing, as a thickener, at least one of chitosan and chitin together with a base oil.

In the grease composition specifically disclosed in PTL 2, flaky or powdery chitosan or chitin having a particle diameter of 4 to 10 μm is used as the thickener.

CITATION LIST

Patent Literature

PTL 1: JP 2008-274091 A
PTL 2: JP 2013-116991 A

SUMMARY OF INVENTION

Technical Problem

Now, with respect to the grease composition specifically disclosed in PTL 2, flaky or powdery chitosan or chitin added as the thickener is blended until its worked penetration reaches 273; however, a specific blending amount is not disclosed.

In general, a biodegradable thickener, such as chitosan, chitin, etc., is low in compatibility with a base oil, and in order to obtain a grease having a high worked penetration, it is necessary to add the thickener in a large amount (about 35 to 50% by mass). Since a grease composition including a large amount of a biodegradable thickener as described in PTL 2 contains a lot of solid components, particles larger than an oil film thickness are present, namely a part of the thickener is floated, so that the wear resistance tends to be inferior.

In order to solve the aforementioned problems, the present invention has been made, and an object thereof is to provide a grease that is low in an environmental load and excellent in safety on the human body and also has an appropriate worked penetration and has a high dropping point, a mechanical component using the grease, and a method for producing a grease.

Solution to Problem

The present inventors have found that a grease using, as a thickener, a hydrophilic nanofiber that is low in an environmental load and excellent in safety on the human body, in which the hydrophilic nanofiber having a predetermined thickness is dispersed, is able to solve the aforementioned problems, thereby leading to accomplishment of the present invention.

Specifically, the present invention is concerned with the following [1] to [4].

[1] A grease containing a base oil and a hydrophilic nanofiber, the hydrophilic nanofiber having a thickness (d) of 0.01 to 500 nm being dispersed therein.

[2] A grease obtained by mixing a hydrophilic nanofiber having a thickness (d') of 0.01 to 500 nm and a base oil.

[3] A mechanical component using the grease as set forth in the above item [1] or [2].

[4] A method for producing a grease including the following step (1):

Step (1): a step of mixing an aqueous dispersion in which a hydrophilic nanofiber having a thickness (d') of 0.01 to 500 nm is blended in water, a base oil, and a dispersion solvent, to prepare a mixed solution.

Advantageous Effects of Invention

The grease of the present invention is low in an environmental load and excellent in safety on the human body and also has an appropriate worked penetration and has a high dropping point.

DESCRIPTION OF EMBODIMENTS

Embodiment of Grease of the Present Invention

The grease of the present invention is a grease (first grease) containing a base oil and a hydrophilic nanofiber having a thickness (d) of 0.01 to 500 nm.

The grease of another embodiment of the present invention is a grease (second grease) obtained by mixing a hydrophilic nanofiber having a thickness (d') of 0.01 to 500 nm and a base oil.

The aforementioned second grease is preferably a grease obtained by mixing an aqueous dispersion in which a hydrophilic nanofiber having a thickness (d') of 0.01 to 500 nm is blended in water, a base oil, and a dispersion solvent. The second grease may be a grease obtained by, after preparation of the mixed solution, removing at least water from the mixed solution, or may be a grease obtained by removing water and the dispersion solvent from the mixed solution.

Details of the aforementioned aqueous dispersion and dispersion solvent, and so on are those described in the following section of "Production Method of Grease of the Present Invention".

In the first grease, the thickness (d) of the hydrophilic nanofiber contained in the grease (namely, the thickness (d) of the hydrophilic nanofiber dispersed in the base oil) is prescribed, and in the second grease, the thickness (d') of the hydrophilic nanofiber before mixing with the base oil is prescribed.

When satisfied with the foregoing prescriptions, the hydrophilic nanofiber is readily uniformly dispersed in the base oil while forming a higher-order structure by the hydrophilic nanofiber. As a result, even when the content of the hydrophilic nanofiber is low, since an appropriate worked penetration and a high dropping point are revealed, a grease with excellent heat resistance may be provided.

It is meant by the terms "the content of the hydrophilic nanofiber is low" as referred to in the present specification that the content of the hydrophilic nanofiber is 20% by mass or less (preferably 15% by mass or less, and more preferably 10% by mass or less) on a basis of the total amount (100% by mass) of the grease.

In the present specification, these "first grease" and "second grease" are also collectively referred to as "grease of the present invention" or "grease of an embodiment of the present invention".

The grease of an embodiment of the present invention may contain, together with the base oil and the hydrophilic nanofiber, a food and a food additive, and further various additives to be blended in a general grease, within a range where the effects of the present invention are not impaired, and influences against the safety on the human body are taken into consideration.

A total content of the base oil and the aforementioned hydrophilic nanofiber in the grease of an embodiment of the present invention is preferably 40% by mass or more, more preferably 60% by mass or more, still more preferably 70% by mass or more, yet still more preferably 80% by mass or more, and even yet still more preferably 90% by mass or more on a basis of the total amount (100% by mass) of the grease.

The respective components that are included in the grease of the present invention are hereunder described.

In the first and second greases of the present invention, details of the hydrophilic nanofiber (such as a suitable shape, e.g., a thickness (d'), etc., a suitable forming material, a suitable range of the content, etc.), details of the base oil (such as a suitable kind, properties, and a range of the content, etc.), details of various additives to be blended together with the hydrophilic nanofiber and the base oil (such as a kind, a range of the content, etc.), and so on are identical with each other.

<Base Oil>

The base oil that is included in the grease of the present invention is properly selected according to an application, and examples thereof include mineral oils, synthetic oils, liquid paraffins, and the like.

The base oil may be either a base oil composed of a single kind or a mixed base oil of two or more kinds thereof.

Examples of the mineral oil include atmospheric distillation or atmospheric residues of crude oils, such as a paraffinic mineral oil, an intermediate base mineral oil, a naphthenic mineral oil, etc.; distillates obtained through vacuum distillation of such an atmospheric residue; refined oils obtained by subjecting such a distillate to at least one treatment of refining treatments, such as solvent deasphalting, solvent extraction, hydrocracking, solvent dewaxing, catalytic dewaxing, hydrogenation refining, etc. (specifically, a solvent-refined oil, a hydrogenated refined oil, a dewaxing treated oil, a white clay treated oil, etc.); mineral oil waxes obtained through isomerization of a wax produced by the Fischer-Tropsch process (a GTL wax (gas to liquids wax)); and the like.

Among those mineral oils, mineral oils classified into Group 3 of the base oil category according to API (American Petroleum Institute) are preferred.

Examples of the synthetic oil include hydrocarbon-based oils, aromatic oils, ester-based oils, ether-based oils, vegetable oils, animal oils, fatty acid esters, and the like.

Examples of the hydrocarbon-based oil include a normal paraffin, an isoparaffin, a poly-α-olefin (PAO), such as poly butene, polyisobutylene, a 1-decene oligomer, a co-oligomer of 1-decene and ethylene, etc. and hydrides thereof, and the like.

Examples of the aromatic oil include alkylbenzenes, such as a monoalkylbenzene, a dialkylbenzene, etc.; alkylnaphthalenes, such as a monoalkylnaphthalene, a dialkylnaphthalene, a polyalkylnaphthalene, etc.; and the like.

Examples of the ester-based oil include diester-based oils, such as dibutyl sebacate, di-2-ethylhexyl sebacate, dioctyl adipate, diisodecyl adipate, ditridecyl adipate, ditridecyl glutarate, methyl acetyl 1 ricinoleate, etc.; aromatic ester-based oils, such as trioctyl trimellitate, tridecyl trimellitate, tetraoctyl pyromellitate, etc.; polyol ester-based oils, such as trimethylolpropane caprylate, trimethylolpropane pelargonate, pentaerythritol-2-ethyl hexanoate, pentaerythritol pelargonate, etc.; complex ester-based oils, such as an oligo ester between a polyhydric alcohol and a mixed fatty acid of a dibasic acid and a monobasic, acid, etc.; and the like.

Examples of the ether-based oil include polyglycols, such as polyethylene glycol, polypropylene glycol, polyethylene glycol monoether, polypropylene glycol monoether, etc.; phenyl ether-based oils, such as a monoalkyl triphenyl ether, an alkyl diphenyl ether, a dialkyl diphenyl ether, pentaphenyl ether, tetraphenyl ether, a monoalkyl tetraphenyl ether, a dialkyl tetraphenyl ether, etc.; and the like.

The vegetable oil is a plant-derived oil, and specifically, examples thereof include rapeseed oil, peanut oil, corn oil, cottonseed oil, canola oil, soybean oil, sunflower oil, palm oil, coconut oil, safflower oil, camellia oil, olive oil, groundnut oil, and the like.

The animal oil is an animal-derived oil, and specifically, examples thereof include lard, neat's foot oil, chrysalis oil, sardine oil, herring oil, and the like.

The fatty acid that constitutes the fatty acid ester is preferably a fatty acid having 8 to 22 carbon atoms, and specifically, examples thereof include caprylic acid, capric acid, lauric acid, myristic acid, palmitic acid, stearic acid, behenic acid, erucic acid, palmitoleic acid, oleic acid, linoleic acid, linolenic acid, isostearic acid, arachidic acid, ricinoleic acid, 12-hydroxystearic acid, and the like.

Specifically, examples of the fatty acid ester include a glycerin fatty acid ester, a polyglycerin fatty acid ester, a propylene glycol fatty acid ester, and the like.

Examples of the glycerin fatty acid ester include glycerin monooleate, glycerin monostearate, glycerin monocaprylate, glycerin dioleate, glycerin distearate, glycerin dicaprylate, and the like.

Examples of the polyglycerin fatty acid ester include diglycerin monooleate, diglycerin monoisostearate, diglycerin dioleate, diglycerin trioleate, diglycerin monostearate, diglycerin distearate, diglycerin tristearate, diglycerin triisostearate, diglycerin monocaprylate, diglycerin dicaprylate, diglycerin tricaprylate, triglycerin monooleate, triglycerin dioleate, triglycerin trioleate, triglycerin tetraoleate, triglycerin monostearate, triglycerin distearate, triglycerin tristearate, triglycerin tetrastearate, triglycerin monocaprylate, triglycerin dicaprylate, triglycerin tricaprylate, triglycerin tetracaprylate, diglycerin monooleic acid monostearic acid ester, diglycerin monooleic acid distearic acid ester, diglycerin monocaprylic acid monostearic acid ester, triglycerin monooleic acid monostearic acid ester, triglycerin dioleic acid distearic acid ester, triglycerin dioleic acid monostearic acid ester, triglycerin monooleic acid monostearic monocaprylic acid ester, diglycerin monolaurate, diglycerin dilaurate, triglycerin monolaurate, triglycerin trilaurate, triglycerin trilaurylate, diglycerin monomyristate, diglycerin dimyristate, triglycerin monomyristate, triglycerin dimyristate, triglycerin trimyristate, diglycerin monolinolate, diglycerin dilinolate, triglycerin monolinolate, triglycerin dilinolate, triglycerin trilinolate, decaglycerin monooleate, decaglycerin monostearate, decaglycerin monocaprylic acid monooleic acid ester, and the like.

Examples of the propylene glycol fatty acid ester include propylene glycol monooleate, propylene glycol monostearate, propylene glycol monocaprylate, propylene glycol monolaurate, and the like.

Examples of the liquid paraffin include alicyclic hydrocarbon compounds having a branched structure or a ring structure and represented by $C_mH_n$ (m and n are each an integer of 1 or more, provided that $n<(2m+2)$), and mixtures thereof.

Among those, from the viewpoint of an affinity with the hydrophilic nanofiber, it is preferred that at least one selected from mineral oils classified into Group 3 of the base oil category according to API, synthetic oils, vegetable oils, animal oils, fatty acid esters, and liquid paraffins is included as the base oil to be included in the grease of an embodiment of the present invention.

A kinematic viscosity at 40° C. of the base oil that is used in an embodiment of the present invention is preferably 10 to 400 $mm^2/s$, more preferably 15 to 300 $mm^2/s$, still more preferably 20 to 200 $mm^2/s$, and yet still more preferably 20 to 130 $mm^2/s$.

When the kinematic viscosity is 10 $mm^2/s$ or more, a phenomenon in which the grease causes oil separation may be inhibited. On the other hand, when the kinematic viscosity is 400 $mm^2/s$ or less, the oil is readily supplied into sliding portions.

As for the base oil that is used in the present invention, a mixed base oil prepared by combining a high-viscosity base oil and a low-density base oil to control the kinematic viscosity to the aforementioned range may be used, too.

A viscosity index of the base oil that is used in an embodiment of the present invention is preferably 60 or more, more preferably 70 or more, and still more preferably 80 or more.

In the present invention, the kinematic viscosity at 40° C. and the viscosity index mean values as measured in conformity with JIS K2283:2003.

The content of the base oil that is included in the grease of an embodiment of the present invention is preferably 40% by mass or more, more preferably 50% by mass or more, still more preferably 60% by mass or more, and yet still more preferably 70% by mass or more, and preferably 99.9% by mass or less on a basis of the total amount (100% by mass) of the grease.

<Hydrophilic Nanofiber>

In the present invention, the hydrophilic nanofiber means a fibrous material constituted of a forming material including a compound with hydrophilicity and having a thickness of 500 nm or less and is distinguished from a flaky material, a powdery material, and a granular material.

In the present invention, as for whether or not a nanofiber is the "hydrophilic nanofiber", in the case where in molding the nanofiber (fibrous material) to be determined in a sheet-like material and dropping a water droplet on the surface of the sheet-like material, (1) a contact angle against water is 90° or less, or (2) the water droplet dropped is quickly absorbed on the sheet-like material, the foregoing nanofiber is determined to be the "hydrophilic nanofiber".

Furthermore, in the present invention, though the "thickness" of the hydrophilic nanofiber is equal to the thickness of a general fibrous material, in a cut surface at the time of cutting perpendicularly to the tangent direction in an arbitrary point on the side surface of the hydrophilic nanofiber, when the initial cut surface is a circle or an oval, then the thickness refers to a diameter or a major axis, whereas when the initial cut surface is a polygon, then the thickness refers to a diameter of a circumcircle of the polygon.

In the case where a flaky, powdery, or granular hydrophilic compound having a size of several μm is blended as the thickener in the base oil, the hydrophilic compound is agglomerated in the base oil and is liable to form a so-called "lump". As a result, an agglomerate of the hydrophilic compound is deposited on the surface of the obtained grease, and the dispersed state is liable to become ununiform. In this case, in order to increase the worked penetration of the obtained grease, the addition of a large quantity of the hydrophilic compound is needed. However, since the grease includes particles larger than the oil film thickness, the grease becomes inferior in wear resistance.

On the other hand, in the grease of the present invention, since the hydrophilic nanofiber having a thickness (d) of 0.01 to 500 nm is dispersed, the hydrophilic nanofiber may be uniformly dispersed in the base oil while forming a higher-order structure. As a result, nevertheless the content of the hydrophilic nanofiber is low, a grease having an appropriate worked penetration and having a high dropping point may be provided.

In the present invention, the "thickness (d)" refers to a thickness of the hydrophilic nanofiber dispersed in the base oil and is distinguished from the "thickness (d')" of the hydrophilic nanofiber" as a raw material prior to being blended in the base oil as described later.

The thickness (d) of the hydrophilic nanofiber dispersed in the base oil is 0.01 to 500 nm; however, from the aforementioned viewpoint, the thickness (d) is preferably 0.1 to 300 nm, more preferably 1 to 200 nm, and still more preferably 2 to 100 nm.

In the grease of the present invention, the dispersion of the hydrophilic nanofiber in which at least the thickness (d) falls within the aforementioned range has only to be confirmed, and a hydrophilic nanofiber whose thickness (d) falls outside the aforementioned range may also be dispersed.

However, in the grease of an embodiment of the present invention, from the viewpoint of providing a grease in which a higher-order structure is readily formed by the hydrophilic nanofiber, and the hydrophilic nanofiber is uniformly dispersed, an average value of the thickness (d) of ten hydrophilic nanofibers that are arbitrarily selected among hydrophilic nanofibers dispersed in the base oil is preferably 0.01 to 500 nm (more preferably 0.1 to 300 nm, still more preferably 1 to 200 nm, and yet still more preferably 2 to 100 nm).

From the aforementioned viewpoint, among the hydrophilic nanofibers included in the grease of the present invention, in ten arbitrarily selected hydrophilic nanofibers, the number of hydrophilic nanofiber whose thickness (d) falls within the aforementioned range is preferably 1 or more (more preferably 5 or more, and still more preferably 7 or more). It is more preferred that all of the ten selected hydrophilic nanofibers are the hydrophilic nanofiber having a thickness (d) falling within the aforementioned range.

An aspect ratio of the hydrophilic nanofiber included in the grease of the present invention is preferably 5 or more, more preferably 10 or more, and still more preferably 15 or more.

The "aspect ratio" is a proportion of a length of the hydrophilic nanofiber objective to the observation to the thickness [length/thickness], and the "length" of the hydrophilic nanofiber refers to a distance between the farthest two points of the hydrophilic nanofiber.

In the case where a part of the hydrophilic nanofiber objective to the observation comes into contact with another hydrophilic nanofiber, so that it is difficult to recognize the "length", among the hydrophilic nanofibers objective to the observation, the length of only a portion where it is possible to measure the thickness is measured, and as a result, the aspect ratio of the foregoing portion may fall within the aforementioned range.

Furthermore, an average value of the aspect ratio (hereinafter also referred to as "average aspect ratio") of ten arbitrarily selected hydrophilic nanofibers among hydrophilic nanofibers included in the grease of the present invention is preferably 5 or more (more preferably 10 or more, and still more preferably 15 or more).

The thickness (d') of the hydrophilic nanofiber as a raw material prior to being blended in the base oil is preferably 0.01 to 500 nm, more preferably 0.1 to 300 nm, still more preferably 1 to 200 nm, and yet still more preferably 2 to 100 nm.

The average aspect ratio of the hydrophilic nanofiber as a raw material prior to being blended in the base oil is preferably 5 or more, more preferably 10 or more, and still more preferably 15 or more.

In the present invention, the "thickness (d)" of the hydrophilic nanofiber dispersed in the base oil and the "thickness (d')" of the hydrophilic nanofiber as a raw material prior to being blended in the base oil as well as the aspect ratio of such a hydrophilic nanofiber is a value as measured using an electron microscope or the like.

The hydrophilic nanofiber that is used in an embodiment of the present invention may be constituted of a forming material including a compound with hydrophilicity. Examples of the compound with hydrophilicity include compounds having a functional group having a hydrogen-bonding hydroxyl group, such as a hydroxyl group, an amino group, etc., metal oxides, and the like.

However, from the viewpoint of providing a grease that is low in an environmental load and excellent in safety on the human body and the viewpoint of making an affinity with the base oil satisfactory, the hydrophilic nanofiber that is used in an embodiment of the present invention preferably includes a polysaccharide, more preferably includes at least one polysaccharide selected from cellulose, carboxymethyl cellulose, chitin, and chitosan, and still more preferably includes cellulose.

The cellulose may contain lignin or hemicellulose. In addition, the cellulose may also be denatured cellulose (for example, lignocellulose, etc.) including a structure derived from lignin or hemicellulose through modification with lignin or hemicellulose.

As the hydrophilic nanofiber that is used in an embodiment of the present invention, a hydrophilic nanofiber, the surface of which is subjected to a modification treatment, may also be used.

More specifically, a hydrophilic nanofiber, the surface of which is subjected to at least one modification treatment selected from esterification, phosphorylation, urethanization, carbamidation, etherification, carboxymethylation, TEMPO oxidation, and periodate oxidation, may also be used.

In the hydrophilic nanofiber that is used in an embodiment of the present invention, the content of the polysaccharide is preferably 60 to 100% by mass, more preferably 70 to 100% by mass, still more preferably 80 to 100% by mass, and yet still more preferably 90 to 100% by mass on a basis of the total amount (100% by mass) of the hydrophilic nanofiber.

A degree of polymerization of the polysaccharide is preferably 50 to 3,000, more preferably 100 to 1,500, still more preferably 150 to 1,000, and yet still more preferably 200 to 800.

In the present invention, the degree of polymerization of the polysaccharide polymer means a value as measured by the viscometry.

In the grease of the present invention, the content of the hydrophilic nanofiber is preferably 0.1 to 20% by mass, more preferably 0.5 to 17% by mass, still more preferably 0.7 to 15% by mass, and yet still more preferably 1.0 to 10% by mass on a basis of the total amount (100% by mass) of the grease.

When the content of the hydrophilic nanofiber is 0.1% by mass or more, a grease having an appropriate worked penetration and having a high dropping point may be provided.

On the other hand, when the content of the hydrophilic nanofiber is 20% by mass or less, a grease that is excellent in wear resistance may be provided.

<Various Additives>

The grease of an embodiment of the present invention may further contain various additives that are blended in general greases within a range where the effects of the present invention are not impaired.

Examples of the various additives include a rust inhibitor, an antioxidant, a lubricity improver, a thickening agent, a modifier, a dispersing auxiliary agent, a detergent dispersant, a corrosion inhibitor, a defoaming agent, an extreme pressure agent, a metal deactivator, and the like.

These various additives may be used either alone or in combination of two or more thereof.

The grease of an embodiment of the present invention may contain the dispersion solvent and water used on the occasion of preparation of a grease within a range where the grease state may be maintained.

In the grease of an embodiment of the present invention, a total content of the dispersion solvent and water is preferably 0 to 60% by mass, more preferably 0 to 30% by mass, still more preferably 0 to 10% by mass, and yet still more preferably 0 to 5% by mass on a basis of the total amount (100% by mass) of the grease.

(Rust Inhibitor)

Examples of the rust inhibitor include a carboxylic acid-based rust inhibitor, an amine-based rust inhibitor, a carboxylate-based rust inhibitor, and the like.

In the case where the grease of an embodiment of the present invention contains the rust inhibitor, the content of the rust inhibitor is preferably 0.1 to 10.0% by mass, more preferably 0.3 to 8.0% by mass, and still more preferably 1.0 to 5.0% by mass on a basis of the total amount (100% by mass) of the grease.

(Antioxidant)

Examples of the antioxidant include an amine-based antioxidant, a phenol-based antioxidant, a sulfur-based antioxidant, zinc dithiophosphate, and the like.

In the case where the grease of an embodiment of the present invention contains the antioxidant, the content of the antioxidant is preferably 0.05 to 10% by mass, more preferably 0.1 to 7% by mass, and still more preferably 0.2 to 5% by mass on a basis of the total amount (100% by mass) of the grease.

(Lubricity Improver)

Examples of the lubricity improver include a sulfur compound (for example, a sulfurized fat and oil, a sulfurized olefin, a polysulfide, a sulfurized mineral oil, a thiophosphate, such as triphenyl phosphorothioate, etc., a thiocarbamate, a thioterpene, a dialkyl thiodipropionate, etc.), a phosphate and a phosphite (for example, tricresyl phosphate, triphenyl phosphite, etc.), and the like.

In the case where the grease of an embodiment of the present invention contains the lubricity improver, the content of the lubricity improver is preferably 0.01 to 20% by mass, more preferably 0.1 to 10% by mass, and still more preferably 0.2 to 5% by mass on a basis of the total amount (100% by mass) of the grease.

(Thickening Agent)

The thickening agent is one for increasing the viscosity of the base oil as needed and is blended for the purpose of adjusting the base oil including the thickening agent to an appropriate kinematic viscosity.

Examples of the thickening agent include a polymethacrylate (PMA), an olefin copolymer (OCP), a polyalkylstyrene (PAS), a styrene-diene copolymer (SCP), and the like.

In the case where the grease of an embodiment of the present invention contains the thickening agent, the content of the thickening agent is preferably 0.01 to 20% by mass, more preferably 0.1 to 10% by mass, and still more preferably 0.2 to 5% by mass on a basis of the total amount (100% by mass) of the grease.

(Modifier)

For the purpose of controlling the hydrophilicity of the hydrophilic nanofiber, the grease of an embodiment of the present invention may be converted to a water-resistant grease by the addition of a modifier.

As the modifier, one utilizing an electrostatic interaction is known, and examples thereof include a cation-type surfactant, such as an alkyl ketene dimer, a fatty acid bisimide, a mixture of a rosin emulsion and ammonium sulfate, etc., a polymethacrylate, and the like.

Among those modifiers, a polymethacrylate is preferred.

In the case where the grease of an embodiment of the present invention contains the modifier, the content of the modifier is preferably 0.01 to 20% by mass, more preferably 0.1 to 10% by mass, and still more preferably 0.2 to 5% by mass on a basis of the total amount (100% by mass) of the grease.

(Dispersing Auxiliary Agent)

Examples of the dispersing auxiliary agent include a succinic acid half ester, urea, various surfactants, and the like.

In the case where the grease of an embodiment of the present invention contains the dispersing auxiliary agent, the content of the dispersing auxiliary agent is preferably 0.01 to 20% by mass, more preferably 0.1 to 10% by mass, and still more preferably 0.2 to 5% by mass on a basis of the total amount (100% by mass) of the grease.

(Detergent Dispersant, Corrosion Inhibitor, Defoaming Agent, Extreme Pressure Agent, and Metal Deactivator)

Examples of the detergent dispersant include a succinimide, a boron-based succinimide, and the like.

Examples of the corrosion inhibitor include a benzotriazole-based compound, a thiazole-based compound, and the like.

Examples of the defoaming agent include a silicone-based compound, a fluorinated silicone-based compound, and the like.

Examples of the extreme pressure agent include a phosphorus-based compound, zinc dithiophosphate, an organomolybdenum, and the like.

Examples of the metal deactivator include a benzotriazole and the like.

In the case where the grease of an embodiment of the present invention contains these additives, the content of each of these additives is preferably 0.01 to 20% by mass, more preferably 0.1 to 10% by mass, and still more preferably 0.2 to 5% by mass on a basis of the total amount (100% by mass) of the grease.

[Characteristics of Grease of the Present Invention]

In the grease of the present invention, a higher-order structure by the hydrophilic nanofiber is readily formed, and the hydrophilic nanofiber is uniformly dispersed. Accordingly, even when the content of the hydrophilic nanofiber is low, the grease of the present invention has an appropriate worked penetration and has a high dropping point.

From the viewpoints of controlling the hardness of the grease to an appropriate range and making the low-temperature torque characteristics and the wear resistance satisfactory, the worked penetration at 25° C. of the grease of an embodiment of the present invention is preferably 130 to 475, more preferably 160 to 445, still more preferably 175 to 430, and yet still more preferably 200 to 350.

In the present specification, the worked penetration of the grease is a value as measured in conformity with JIS K2220 7:2013.

The dropping point of the grease of an embodiment of the present invention is preferably 180° C. or higher, more preferably 200° C. or higher, and still more preferably 220° C. or higher.

In the present specification, the dropping point of the grease is a value as measured in conformity with JIS K2220 8:2013.

[Production Method of Grease of the Present Invention]

The method for producing a grease of the present invention preferably includes at least the following step (1), and more preferably includes the following steps (1) and (2).

Step (1): a step of mixing an aqueous dispersion in which a hydrophilic nanofiber having the thickness (d') of 0.01 to 500 nm is blended in water, a base oil, and a dispersion solvent, to prepare a mixed solution.

Step (2): a step of removing water from the aforementioned mixed solution.

In the grease obtained through such a step or steps, agglomeration among the hydrophilic nanofibers is inhibited in the base oil, whereby the hydrophilic nanofiber having the thickness (d) of 0.01 to 500 nm may be dispersed in a state where the fibrous shape is maintained. As a result, a grease in which a higher-order structure by the hydrophilic nanofiber is formed in the base oil, and the hydrophilic nanofiber is uniformly dispersed may be produced.

The steps (1) and (2) are hereunder described.

<Step (1)>

The step (1) is a step of mixing an aqueous dispersion in which a hydrophilic nanofiber having the thickness (d') of 0.01 to 500 nm is blended in water, a base oil, and a dispersion solvent, to prepare a mixed solution.

Details of the hydrophilic nanofiber and the base oil that are used in the step (1) are as described above.

The "thickness (d')" as referred to herein expresses the thickness of the hydrophilic nanofiber as a raw material prior to being blended in the base oil or water as described above, and a suitable range of the "thickness (d')" is the same as described above.

A solid component concentration of the aqueous dispersion having the hydrophilic nanofiber blended therein is typically 0.1 to 70% by mass, preferably 0.1 to 65% by mass, more preferably 0.1 to 60% by mass, still more preferably 0.5 to 55% by mass, and yet still more preferably 1.0 to 50% by mass on a basis of the total amount (100% by mass) of the aqueous dispersion.

The aqueous dispersion may be prepared by blending the hydrophilic nanofiber and optionally, a surfactant and so on in water, followed by thoroughly stirring manually or by using a stirrer.

The dispersion solvent may be a solvent that is good in compatibility with both water and oil, and it is preferably at least one selected from aprotic polar solvents, such as N,N-dimethylformamide (DMF), N,N-dimethylacetamide (DMAc), N-methylpyrrolidone (NMP), etc.; alcohols, such as propanol, ethylene glycol, propylene glycol, hexylene glycol, etc.; and surfactants, such as a polyglycerin fatty acid ester, a sorbitan acid ester, etc.

A blending amount of the dispersion solvent in the mixed solution that is prepared in the step (1) is preferably 0.1 to 50% by mass, more preferably 0.5 to 40% by mass, and still more preferably 1.0 to 30% by mass on a basis of the total amount (100% by mass) of the mixed solution.

A blending amount of water in the mixed solution that is prepared in the step (1) is preferably 1 to 60% by mass, more preferably 3 to 50% by mass, and still more preferably 5 to 40% by mass on a basis of the total amount (100% by mass) of the mixed solution.

A blending ratio of water to the dispersion solvent [(water)/(dispersion solvent)] in the mixed solution that is prepared in the step (1) is preferably 0.01 to 600, more preferably 0.05 to 400, still more preferably 0.1 to 300, and yet still more preferably 0.2 to 200 in terms of a mass ratio.

In the mixture, the aforementioned various additives that are blended in general greases may be added together with the aqueous dispersion having the hydrophilic nanofiber blended therein, the base oil, and the dispersion solvent. The mixture may be prepared by mixing these components, followed by thoroughly stirring manually or by using a stirrer.

So long as the grease obtained after the step (1) is in a state where the grease state may be maintained, it may contain the dispersion solvent and water without undergoing the following step (2). In this case, the grease of the present invention may be obtained after going through a post-treatment step, such as homogenization with a roll mill or the like, etc.

<Step (2)>

The step (2) is a step of removing at least water from the mixed solution prepared in the step (1).

In the present step, the dispersion solvent may be removed together with water from the mixed solution.

As a method of removing water and the dispersion solvent, a method of heating the mixture to evaporate and remove water and the dispersion solvent is preferred.

As a condition under which water is evaporated and removed, it is preferred that the mixture is heated at a temperature ranging from 0 to 100° C. in an environment at a pressure of 0.001 to 0.1 MPa.

As a condition under which the dispersion solvent is evaporated and removed, it is preferred that the mixture is heated at a temperature ranging from [{boiling point (° C.) of the dispersion solvent}-120° C.] to [{boiling point (° C.) of the dispersion solvent}-0° C.] in an environment at a pressure of 0.001 to 0.1 MPa.

The evaporation and removal of water and the dispersion solvent may be performed by means of atmospheric distillation.

After removing water and the dispersion solvent from the mixture, the grease of the present invention may be obtained after going through a post-treatment step, such as homogenization with a roll mill or the like, etc., as needed.

[Mechanical Component Using the Grease of the Present Invention]

The grease of the present invention is low in an environmental load and excellent in safety on the human body and also has an appropriate worked penetration and has a high dropping point. In addition, even when the content of the hydrophilic nanofiber that is the thickener is low, the grease of the present invention has an appropriate worked penetration and has a high dropping point, and therefore, the wear resistance may be improved, too.

Accordingly, even when the grease is scattered or leaked, the mechanical component using the grease of the present invention is less in problems regarding environmental preservation or safety on the human body, and a mechanical component, lubricating characteristics of which are maintained over a long period of time even at a high temperature, may be provided.

Examples of the mechanical component using the grease of the present invention include bearings, gears, and the like. More specifically, examples thereof include various bearings, such as a sliding bearing, a roll bearing, an oil-impregnated bearing, a fluid bearing, etc., a gear, an internal combustion engine, a brake, a component for torque transmission apparatus, a fluid clutch, a component for compression apparatus, a chain, a component for hydraulic apparatus, a component for vacuum pump apparatus, a clock component, a component for hard disk, a component for refrigerating machine, a component for cutting machine, a component for rolling machine, a component for draw bench, a component for rolling machine, a component for forging machine, a component for heat treatment machine, a component for heat medium, a component for washing machine, a component for shock absorber, a component for sealing apparatus, and the like.

The grease of an embodiment of the present invention is also suitable for a lubricating application of sliding portions of food machinery, such as bearings, gears, etc.

From the foregoing sections, the present invention also provides the following mechanical component and method for use of grease.

(1) A mechanical component using the grease of the present invention.

(2) A method for use of grease, including using the grease of the present invention for lubrication of a mechanical component for food machinery.

The mechanical component as described in the above item (1) is preferably a mechanical component to be installed in a food machinery for mixing of food raw materials, production of foods, and so on.

The "grease" that is used in the above items (1) and (2) is the grease of the present invention, and details thereof are those described above.

EXAMPLES

Next, the present invention is described in more detail by reference to the Examples, but it should be construed that the present invention is by no means limited to these Examples.

Various characteristics were determined according to the following methods.

(1) Kinematic Viscosity at 40° C. and Viscosity Index

The measurement was performed in conformity with JIS K2283:2000.

(2) Thickness and Aspect Ratio of Hydrophilic Nanofiber

Ten arbitrarily selected hydrophilic nanofibers were each measured with respect to a thickness and a length by using a transmission electron microscope (TEM), and a value as calculated from "length/thickness" was defined as an "aspect ratio" of the hydrophilic nanofiber measured.

(3) Worked Penetration

The measurement was performed at 25° C. in conformity with JIS K2220 7:2013.

(4) Dropping Point

The measurement was performed in conformity with JIS K2220 8:2013.

Details of a base oil, hydrophilic nanofiber dispersions, and dispersion solvents used in Examples 1 to 3, Comparative Example 1, and Reference Example 1 are as follows.

<Base Oil>

Aromatic ester-based oil: Kinematic viscosity at 40° C.=91 $mm^2/s$, viscosity index=80

<Hydrophilic Nanofiber Dispersion>

CNF dispersion (1): A trade name "BiNFi-s", manufactured by Sugino Machine Limited (an aqueous dispersion including 2.0% by mass of a cellulose nanofiber (CNF) having a degree of polymerization of 600 (thickness (d')=20 to 50 nm (average value: 35 nm), aspect ratio=100 or more (average value: 100 or more)))

CNF dispersion (2): A trade name "BiNFi-s", manufactured by Sugino Machine Limited (an aqueous dispersion including 2.0% by mass of a cellulose nanofiber (CNF) having a degree of polymerization of 300 (thickness (d')=20 to 50 nm (average value: 35 nm), aspect ratio=100 or more (average value: 100 or more)))

<Dispersion Solvent>

DMF N,N-Dimethylformamide

DMAc: N,N-Dimethylacetamide

Example 1

180 g of the aforementioned CNF dispersion (1) (CNF amount: 3.6 g) that is the hydrophilic nanofiber dispersion, 140 g of the aforementioned aromatic ester oil that is the base oil, and 150 g of DMF that is the dispersion solvent were mixed and thoroughly stirred at 25° C. to prepare a mixed solution.

The mixed solution was then heated to 70° C. in an environment at 0.01 MPa to evaporate and remove water from the mixed solution, and the resultant was further heated to 110° C. in an environment at 0.01 MPa, to evaporate and remove DMF from the mixed solution.

Subsequently, the resultant was cooled to room temperature (25° C.) and then subjected to a homogenization treatment with a triple roll mill, to obtain a grease having the content of CNF of 2.5% by mass.

All of ten CNFs arbitrarily selected among CNFs dispersed in the obtained grease had a thickness (d) of 20 to 50 nm (an average value of the thickness (d) was 35 nm), and all of these ten CNFs had an aspect ratio of 100 or more (an average value of the aspect ratio was 100 or more, too). In addition, the grease had a worked penetration of 273 and a dropping point of 250° C.

Example 2

A grease having the content of CNF of 2.5% by mass was obtained in the same manner as in Example 1, except for using the aforementioned CNF dispersion (2) as the hydrophilic nanofiber dispersion.

All of ten CNFs arbitrarily selected among CNFs dispersed in the obtained grease had a thickness (d) of 20 to 50 nm (an average value of the thickness (d) was 35 nm), and all of these ten CNFs had an aspect ratio of 100 or more (an average value of the aspect ratio was 100 or more, too). In addition, the grease had a worked penetration of 259 and a dropping point of 258° C.

Example 3

A grease having the content of CNF of 2.5% by mass was obtained in the same manner as in Example 1, except for using DMAc as the dispersion solvent.

All of ten CNFs arbitrarily selected among CNFs dispersed in the obtained grease had a thickness (d) of 20 to 50 nm (an average value of the thickness (d) was 35 nm), and all of these ten CNFs had an aspect ratio of 100 or more (an average value of the aspect ratio was 100 or more, too). In addition, the grease had a worked penetration of 273 and a dropping point of 245° C.

Comparative Example 1

60 g of a cellulose powder (particle diameter: 38 μm, passed through a 400-mesh screen, manufactured by Wako Pure Chemical industries, Ltd.) and 90 g of the aromatic ester oil were mixed and then thoroughly stirred at 25° C. The resultant was subjected to a homogenization treatment with a triple roll mill, to obtain a grease including 40% by mass of the cellulose powder.

The obtained grease had a worked penetration of 289 and a dropping point of 300° C. or higher (burnt and solidified during the measurement). On the surface of the obtained grease, floating of particles larger than the oil film thickness was seen.

Reference Example 1

15 g of diphenylmethane-4,4'-diisocyanate (MDI) was blended in 100 g of the aromatic ester oil and then heated for dissolution at 70° C., to prepare an MDI solution. In addition, 15 g of octylamine was blended in 70 g of the aromatic ester oil in another reactor and then heated for dissolution at 70° C., to prepare an octylamine solution.

Then, in a grease production kettle, the aforementioned MDI solution was charged, and the aforementioned octylamine solution was dropped while vigorously stirring, followed by heating for reaction. Then, at the point of time when the reaction temperature reached 160° C., the resultant was held at 160° C. for 1 hour, thereby thoroughly undergoing the reaction.

Subsequently, the reaction mixture was cooled to room temperature (25° C.) and then subjected to a homogenization treatment with a triple roll mill, to obtain a grease.

The obtained grease had a worked penetration of 273 and a dropping point of 280° C.

In the greases of Examples 1 to 3, nevertheless the content of the hydrophilic nanofiber that is the thickener was low as 2.5% by mass, the results in which these greases had the worked penetration and the dropping point of the same degrees as in the grease of Reference Example 1 were revealed.

The greases of Examples 1 to 3 use the hydrophilic nanofiber as the thickener, and therefore, they are low in an environmental load and excellent in safety on the human body. In addition, in the greases of Examples 1 to 3, the content of a hydrophilic nanofiber having a thickness larger than the oil film thickness is low, and therefore, it may be considered that they are excellent in wear resistance.

On the other hand, according to Comparative Example 1, in order to obtain a grease having a high worked penetration by using the cellulose powder as the thickener, it is noted that it is necessary to blend the cellulose powder in a large amount as 40% by mass. In addition, since the grease obtained in Comparative Example 1 included the cellulose powder in a large amount as 40% by mass, floating of large particles was seen on the surface, so that it was the state that it is hard to say that the cellulose powder is uniformly dispersed. Accordingly, it may be considered that the grease of Comparative Example 1 is inferior in wear resistance.

Details of base oils, thickeners, various additives, and dispersion solvents used in Examples 4 to 17 are as follows.

<Base Oil>

Mineral oil: Kinematic viscosity at 40° C.=91 $mm^2/s$, viscosity index=105, paraffinic mineral oil Vegetable oil: Kinematic viscosity at 40° C.=39 $mm^2/s$, viscosity index=205, rapeseed oil PAO: Kinematic viscosity at 40° C.=64 $mm^2/s$, viscosity index=135, poly-α-olefin <Thickener>

CNF dispersion (1): A trade name "BiNFi-s", manufactured by Sugino Machine Limited (an aqueous dispersion including 2.0% by mass of a cellulose nanofiber (CNF) having a degree of polymerization of 600 (thickness (d')=20 to 50 nm (average value: 35 nm), aspect ratio=100 or more (average value: 100 or more)))

CNF dispersion (3): A trade name "BiNFi-s", manufactured by Sugino Machine Limited (an aqueous dispersion including 2.0% by mass of a cellulose nanofiber (CNF) having a degree of polymerization of 200 (thickness (d')=20 to 50 nm (average value: 35 nm), aspect ratio=100 or more (average value: 100 or more)))

Lignocellulose dispersion: An aqueous dispersion including 2.0% by mass of a lignocellulose nanofiber, thickness (d') of the lignocellulose nanofiber=20 to 50 nm (average value: 35 nm), aspect ratio=100 or more (average value: 100 or more)

Esterified cellulose dispersion: An aqueous dispersion including 2.0% by mass of an esterified cellulose nanofiber, thickness (d') of the esterified cellulose nanofiber=20 to 50 nm (average value: 35 nm), aspect ratio=100 or more (average value: 100 or more)

All of the nanofibers included in the aforementioned dispersions revealed such results that on dropping a water droplet on the surface of the sheet-like material obtained by molding each nanofiber, "a contact angle against water is 90° or less", or "the dropped water droplet is absorbed on the sheet-like material before measuring the contact angle". Accordingly, all of the nanofibers are corresponding to the "hydrophilic nanofiber" as referred to in the present invention.

<Various Additives>

PMA: Polymethacrylate (PMA), used as a modifier

Succinic acid half ester: Used as a dispersing auxiliary agent

Urea: Used as a dispersing auxiliary agent

<Dispersion Solvent>

Dispersion solvent (1): Hexylene glycol

Dispersion solvent (2): Polyglycerin fatty acid ester

Dispersion solvent (3): Sorbitan laurate

Examples 4 to 13

The base oil, the thickener, the various additives, and the dispersion solvent of kinds and blending amounts shown in Table 1 were mixed and thoroughly stirred at 25° C., to prepare mixed solutions. The blending amount of the thickener shown in Table 1 is a solid component blending amount of the thickener included in the dispersion exclusive of the solvent.

Each of the mixed solutions was then heated to 70° C. in an environment at 0.01 MPa, to evaporate and remove water from the mixed solution, and the resultant was further heated to 110° C. in an environment at 0.01 MPa, to evaporate and remove the dispersion solvent from the mixed solution.

Subsequently, the resultant was cooled to room temperature (25° C.) and then subjected to a homogenization treatment with a triple roll mill, to obtain greases (a) to (j) each having a thickener concentration shown in Table 1.

With respect to the prepared greases (a) to (j), the worked penetration and the dropping point were measured. In addition, with respect to the greases (a) to (d), the following test for water washout resistance was also performed. These results are shown in Table 1.

[Test for Water Washout Resistance]

In conformity with the test method for water washout resistance according to JIS K2220:2013, a mass of the grease washed out into water relative to 100% by mass of the amount of grease before the test was measured with water at 38° C.

It may be said that a grease in which the foregoing mass is large is a grease having excellent washability with water, whereas it may be said that a grease in which the foregoing mass is small is a grease having excellent water resistance.

TABLE 1

| | | | | Example 4 (a) | Example 5 (b) | Example 6 (c) | Example 7 (d) | Example 8 (e) | Example 9 (f) | Example 10 (g) | Example 11 (h) | Example 12 (i) | Example 13 (j) |
|---|---|---|---|---|---|---|---|---|---|---|---|---|---|
| Components used for preparation of grease | Base oil | Mineral oil | Parts by mass | 94.0 | 88.0 | 88.0 | 82.0 | 90.5 | 91.0 | — | — | — | 88.0 |
| | | Vegetable oil | | — | — | — | — | — | — | 80.0 | 86.0 | — | — |
| | | PAO | | — | — | — | — | — | — | — | — | 86.0 | — |
| | Thickener (*1) | CNF dispersion (1) | | 6.0 | 6.0 | — | — | — | — | — | 8.0 | 8.0 | 6.0 |
| | | CNF dispersion (3) | | — | — | 12.0 | 12.0 | — | — | 14.0 | — | — | — |
| | | Lignocellulose dispersion | | — | — | — | — | 9.5 | — | — | — | — | — |

TABLE 1-continued

| | | | Example 4 (a) | Example 5 (b) | Example 6 (c) | Example 7 (d) | Example 8 (e) | Example 9 (f) | Example 10 (g) | Example 11 (h) | Example 12 (i) | Example 13 (j) |
|---|---|---|---|---|---|---|---|---|---|---|---|---|
| | Esterified cellulose dispersion | | — | — | — | — | — | 9.0 | — | — | — | — |
| Various additives | PMA | | — | 3.0 | — | 3.0 | — | — | 3.0 | 3.0 | 3.0 | 3.0 |
| | Succinic acid half ester | | — | 3.0 | — | 3.0 | — | — | 3.0 | 3.0 | 3.0 | — |
| | Urea | | — | — | — | — | — | — | — | — | — | 3.0 |
| Dispersion solvent | Dispersion solvent (1) | | 5.0 (*2) | 5.0 (*2) | 5.0 (*2) | 5.0 (*2) | 5.0 (*2) | 5.0 (*2) | 5.0 (*2) | 5.0 (*2) | 5.0 (*2) | 5.0 (*2) |
| | Dispersion solvent (2) | | | | | | | | | | | |
| | Dispersion solvent (3) | | | | | | | | | | | |
| Properties of grease | Thickener concentration | % by mass | 6.0 | 6.0 | 12.0 | 12.0 | 9.5 | 9.0 | 14.0 | 8.0 | 8.0 | 6.0 |
| | Worked penetration | — | 264 | 282 | 264 | 251 | 263 | 258 | 260 | 254 | 273 | 271 |
| | Dropping point | ° C. | 263 | 267 | >300 | >300 | 271 | 277 | 283 | 275 | 260 | 265 |
| | Water washout resistance | % by mass | 95 | 1.9 | 97 | 2.1 | — | — | — | — | — | — |

(*1): The blending amount of the thickener expresses a solid component blending amount of the thickener exclusive of the solvent.

(*2): The dispersion solvent (1) is evaporated and removed in the preparation process of grease, and the dispersion solvent (1) is not substantially included in the obtained grease.

The greases (a) to (j) obtained in Examples 4 to 13 revealed the results such that they had an appropriate worked penetration and had a high dropping point.

With respect to the greases (a) to (j), all of various ten CNFs arbitrarily selected among various CNFs dispersed in each grease had the thickness (d) of 20 to 50 nm (average value: 35 nm), and the various ten CNFs had an aspect ratio of 100 or more (an average value of the aspect ratio was 100 or more, too).

In addition, from the results of the test for water washout resistance, it may be said that the greases (a) and (c) are a grease having high washability with water. On the other hand, the greases (b) and (d) are a grease having excellent water resistance.

Examples 14 to 16

The base oil, the thickener, and the dispersion solvent of kinds shown in Table 2 were blended such that the content of each of the components in the grease after preparation is the amount shown in Table 2, and these components were thoroughly stirred at 25° C., to prepare mixed solutions. The content of the thickener shown in Table 2 is a solid component blending amount of the thickener included in the dispersion exclusive of the solvent.

Each of the mixed solutions was then heated to 70° C. in an environment at 0.01 MPa, to evaporate and, remove water from the mixed solution. The dispersion solvent shown in Table 2 was allowed to remain without performing an operation of evaporation and removal.

Subsequently, the resultant was cooled to room temperature (25° C.) and then subjected to a homogenization treatment with a triple roll mill, to obtain greases (k) to (m) each having a thickener concentration shown in Table 2. As shown in Table 2, the content of water in each of the greases (k) to (m) was 0% by mass.

Each of the greases (k) to (m) uses the dispersion solvent that is admitted as a food additive, uses PAO or the vegetable oil as the base oil, and also uses a cellulose nanofiber as the thickener. Thus, these greases (k) to (m) are excellent in safety and suitable as a lubricant for food machinery.

Example 17

The base oil, the thickener, and the dispersion solvent of kinds shown in Table 2 were blended such that the content of each of the components in the grease after preparation is the amount shown in Table 2, and these components were thoroughly stirred at 25° C., to prepare a mixed solution. The content of the thickener shown in Table 2 is a solid component blending amount of the thickener included in the dispersion exclusive of the solvent.

The mixed solution was subjected to a homogenization treatment with a triple roll mill, to obtain a grease (n) having a thickener concentration shown in Table 2. As shown in Table 2, the content of water in the grease (n) is 38.0% by mass, and the foregoing water is derived from the dispersion added as the thickener.

With respect to the prepared greases (k) to (n), the worked penetration and the dropping point were measured. These results are shown in Table 2.

TABLE 2

| | | | | Example 14 (k) | Example 15 (j) | Example 16 (m) | Example 17 (n) |
|---|---|---|---|---|---|---|---|
| Composition of grease | Base oil | Mineral oil | % by mass | — | — | — | 42.0 |
| | | Vegetable oil | | 89.0 | — | 91.0 | — |
| | | PAO | | — | 89.0 | — | — |
| | Thickener (*1) | CNF dispersion (1) | | 8.0 | 8.0 | 6.0 | 5.0 |
| | | CNF dispersion (3) | | — | — | — | — |
| | | Lignocellulose dispersion | | — | — | — | — |
| | | Esterified cellulose dispersion | | — | — | — | — |

TABLE 2-continued

| | | | Example 14 (k) | Example 15 (j) | Example 16 (m) | Example 17 (n) |
|---|---|---|---|---|---|---|
| Dispersion solvent | Dispersion solvent (1) | | — | — | — | 15.0 |
| | Dispersion solvent (2) | | 3.0 | 3.0 | — | — |
| | Dispersion solvent (3) | | — | — | 3.0 | — |
| — | Water | | 0 | 0 | 0 | 38.0 |
| Properties of grease | Thickener concentration | % by mass | 8.0 | 8.0 | 6.0 | 5.0 |
| | Worked penetration | — | 280 | 268 | 281 | 293 |
| | Dropping point | ° C. | 261 | 260 | 288 | — |

(*1): The blending amount of the thickener expresses a solid component blending amount of the thickener exclusive of the solvent.

In Examples 14 to 16, the grease could be prepared even in a state where the dispersion solvent remained, and as a result, each of the obtained greases (k) to (m) had an appropriate worked penetration and had a high dropping point.

In addition, even in Example 17, the grease could be prepared even in a state where water remained, and as a result, the obtained grease (n) had an appropriate worked penetration. Though the dropping point of the grease (n) could not be measured because of an influence of the boiling point of water included in the grease (n), taking into consideration the matter that the CNF used as the thickener has such properties that it is hardly thermally decomposed, it may be considered that the grease (n) is a grease having excellent heat resistance.

In addition, with respect to the greases (k) to (n), all of ten CNFs arbitrarily selected among CNFs dispersed in each grease had the thickness (d) of 20 to 50 nm (average value: 35 nm), and the various ten CNFs had an aspect ratio of 100 or more (an average value of the aspect ratio was 100 or more, too).

The invention claimed is:

1. A grease, comprising a base oil and a hydrophilic nanofiber, the hydrophilic nanofiber having a thickness (d) of 0.01 to 500 nm being dispersed therein, wherein:

an aspect ratio of the hydrophilic nanofiber is 100 or more; and the hydrophilic nanofiber comprises at least one polysaccharide selected from the group consisting of cellulose, carboxymethyl cellulose, chitin, and chitosan; and wherein the hydrophilic nanofiber is a surface-modified nanofiber, the modification treatment is selected from the group consisting of esterification, phosphorylation, urethanization, carbamidation, etherification, carboxymethylation, TEMPO oxidation, and periodate oxidation.

2. The grease according to claim 1, wherein a content of the hydrophilic nanofiber is from 0.1 to 20% by mass on a basis of a total amount of the grease.

3. The grease according to claim 1, wherein the hydrophilic nanofiber comprises at least one polysaccharide selected from the group consisting of cellulose, carboxymethyl cellulose, and chitosan.

4. The grease according to claim 1, further comprising a water resistance improver.

5. A grease obtained by mixing a hydrophilic nanofiber having a thickness (d') of 0.01 to 500 nm and a base oil, wherein:

an aspect ratio of the hydrophilic nanofiber is 100 or more; and the hydrophilic nanofiber comprises at least one polysaccharide selected from the group consisting of cellulose, carboxymethyl cellulose, chitin, and chitosan; and wherein the hydrophilic nanofiber is a surface-modified nanofiber, the modification treatment is selected from the group consisting of esterification, phosphorylation, urethanization, carbamidation, etherification, carboxymethylation, TEMPO oxidation, and periodate oxidation.

6. The grease according to claim 5, obtained by:

dispersing the hydrophilic nanofiber having a thickness (d') of 0.01 to 500 nm in an aqueous medium to obtain an aqueous dispersion in which the hydrophilic nanofiber is dispersed;

mixing the aqueous dispersion with a base oil and a dispersion solvent to prepare a mixed solution; and removing water from the mixed solution, to obtain a grease in which the hydrophilic nanofiber has a thickness (d) of 0.01 to 500 nm.

7. A mechanical component, comprising the grease according to claim 1.

8. A method for producing a grease, the method comprising:

dispersing a hydrophilic nanofiber having a thickness (d') of 0.01 to 500 nm in an aqueous medium to obtain an aqueous dispersion in which the hydrophilic nanofiber is dispersed;

mixing the aqueous dispersion with a base oil and a dispersion solvent to prepare a mixed solution; and optionally removing water from the mixed solution, to obtain a grease in which the hydrophilic nanofiber has a thickness (d) of 0.01 to 500 nm, wherein:

an aspect ratio of the hydrophilic nanofiber in the grease is 100 or more; and the hydrophilic nanofiber comprises at least one polysaccharide selected from the group consisting of cellulose, carboxymethyl cellulose, chitin, and chitosan, wherein the hydrophilic nanofiber is a surface-modified nanofiber, the modification treatment is selected from the group consisting of esterification, phosphorylation, urethanization, carbamidation, etherification, carboxymethylation, TEMPO oxidation, and periodate oxidation.

9. The method for producing a grease according to claim 8, comprising removing the water from the mixed solution to obtain the grease.

10. The method for producing a grease according to claim 9, wherein the removing comprises removing the water and the dispersion solvent from the mixed solution to obtain the grease.

11. The method for producing a grease according to claim 8, wherein the dispersion solvent is at least one selected from the group consisting of an aprotic polar solvent, an alcohol, and a surfactant.

* * * * *